US006047556A

United States Patent [19]

Lifson

[11] Patent Number: 6,047,556

[45] Date of Patent: Apr. 11, 2000

[54] PULSED FLOW FOR CAPACITY CONTROL

[75] Inventor: Alexander Lifson, Manlius, N.Y.

[73] Assignee: Carrier Corporation, Syracuse, N.Y.

[21] Appl. No.: 08/986,447

[22] Filed: Dec. 8, 1997

[51] Int. Cl.[7] ..... F25B 3/00

[52] U.S. Cl. ..... 62/196.2; 62/196.4; 62/217; 62/513; 251/129.05

[58] Field of Search ..... 62/196.2–196.4, 62/217, 513; 251/129.05

[56] References Cited

U.S. PATENT DOCUMENTS 4,838,037 6/1989 Wood ..... 251/129.05 X
4,854,130 8/1989 Naruse et al. ..... 62/513 X
5,063,750 11/1991 Englund ..... 62/196.3
5,226,472 7/1993 Benevelli et al. ..... 62/217 X
5,634,350 6/1997 De Medio ..... 62/217
5,816,055 10/1998 Ohman ..... 62/196.3 X

*Primary Examiner*—Henry Bennett
*Assistant Examiner*—Marc Norman

[57] ABSTRACT

Step control in capacity modulation of a refrigeration or air conditioning circuit is achieved by rapidly cycling a solenoid valve in the suction line, economizer circuit or in a bypass with the percent of "open" time for the valve regulating the rate of flow therethrough. A common port in the compressor is used for economizer flow and for bypass.

3 Claims, 1 Drawing Sheet

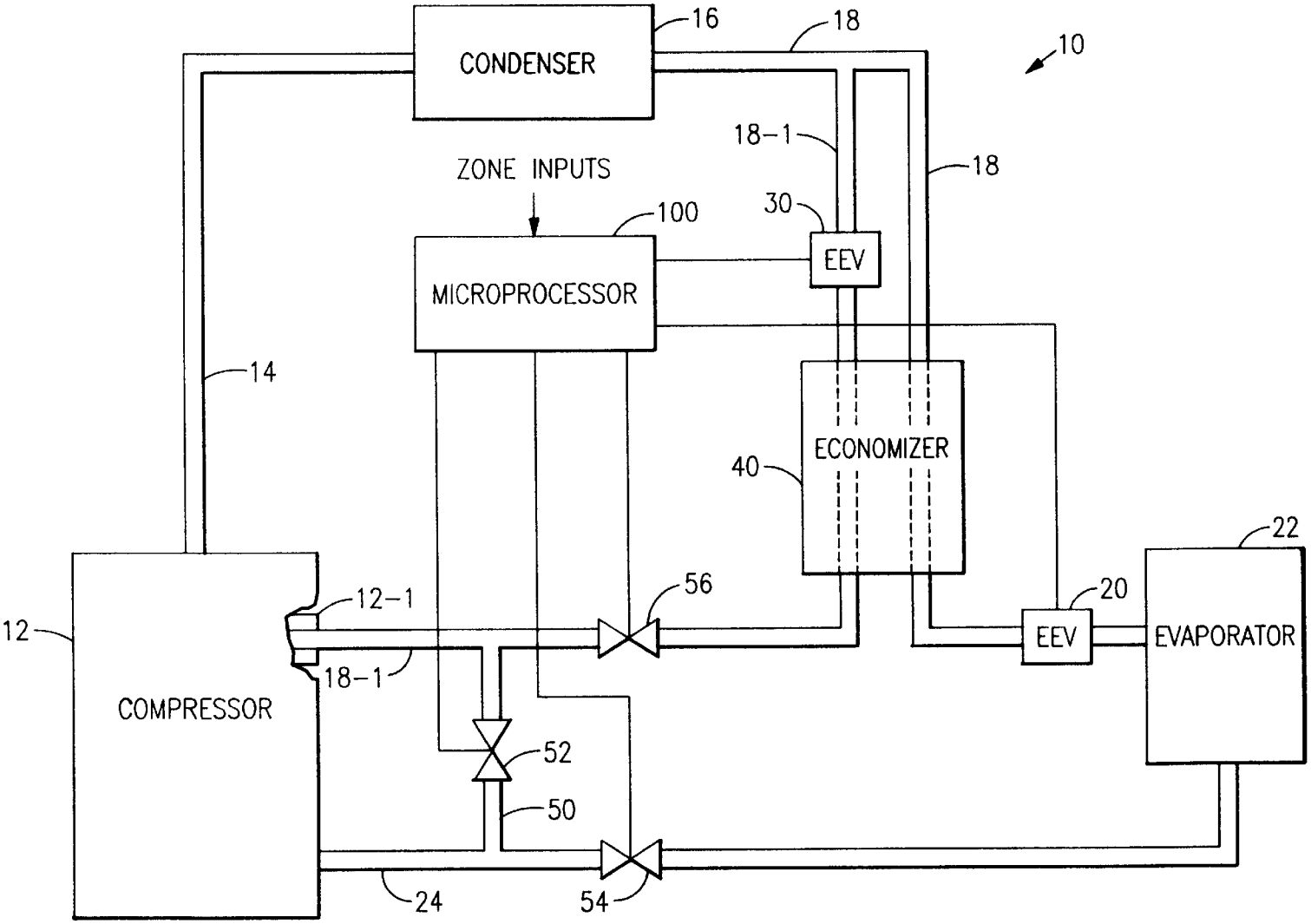
10
CONDENSER
16
18
18
18-1
EEV
30
ZONE INPUTS
MICROPROCESSOR
100
ECONOMIZER
40
EEV
20
EVAPORATOR
22
56
52
50
54
24
12-1
18-1
14
COMPRESSOR
12

PULSED FLOW FOR CAPACITY CONTROL

BACKGROUND OF THE INVENTION

In a closed air conditioning or refrigeration system there are a number of methods of unloading that can be employed. Commonly assigned U.S. Pat. No. 4,938,666 discloses unloading one cylinder of a bank by gas bypass and unloading an entire bank by suction cutoff. Commonly assigned U.S. Pat. No. 4,938,029 discloses the unloading of an entire stage of a compressor and the use of an economizer. Commonly assigned U.S. Pat. No. 4,878,818 discloses the use of a valved common port to provide communication with suction for unloading or with discharge for $V_i$ control, where $V_i$ is the discharge pressure to suction pressure ratio. In employing these various methods, the valve structure is normally fully open, fully closed, or the degree of valve opening is modulated so as to remain at a certain fixed position. One problem associated with these arrangements is that capacity can only be controlled in steps or expensive motor driven modulation valves must be employed to fix the valve opening at a certain position for capacity control.

SUMMARY OF THE INVENTION

Gradual compressor capacity can be achieved by rapidly cycling solenoid valve(s) between fully open and fully closed positions. The cycling solenoid valve(s) can be located in the compressor suction line, the compressor economizer line and/or the compressor bypass line which connects the economizer line to the suction line. The percentage of time that a valve is open determines the degree of modulation being achieved. However, because the cycling time is so much shorter than the response time of the system, it is as though the valve(s) are partially opened rather than being cycled between their open and closed positions.

It is an object of this invention to provide continuous capacity control.

It is another object of this invention to provide step control in capacity modulation.

It is a further object of this invention to provide a less expensive alternative to the use of variable speed compressors.

It is another object of this invention to provide a less expensive alternative to a modulation valve. These objects, and others as will become apparent hereinafter, are accomplished by the present invention.

Basically, gradual or step control in capacity modulation of a refrigeration circuit is achieved by rapidly cycling a solenoid valve in the compressor suction line and/or the compressor economizer line and/or bypass line.

BRIEF DESCRIPTION OF THE DRAWING

For a fuller understanding of the present invention, reference should now be made to the following detailed description thereof taken in conjunction with the accompanying drawing wherein.

The FIGURE is a schematic representation of an economized refrigeration or air conditioning system employing the present invention.

DESCRIPTION OF THE PREFERRED EMBODIMENT

In the FIGURE, the numeral 12 generally designates a hermetic compressor in a closed refrigeration or air conditioning system 10. Starting with compressor 12, the system

10 serially includes discharge line 14, condenser 16, line 18, expansion device 20, evaporator 22, and suction line 24 completing the circuit. Line 18-1 branches off from line 18 and contains expansion device 30 and connects with compressor 12 via port 12-1 at a location corresponding to an intermediate point in the compression process. Economizer heat exchanger 40 is located such that line 18-1, downstream of expansion device 30, and line 18, upstream of expansion device 20, are in heat exchange relationship. The expansion devices 20 and 30 are labeled as electronic expansion devices, EEV, and are illustrated as connected to microprocessor 100. In the case of expansion device 20, at least, it need not be an EEV and might, for example, be a thermal expansion device, TEV. What has been described so far is generally conventional. The present invention provides bypass line 50 connecting lines 18-1 and 24 downstream of economizer heat exchanger 40 and evaporator 22, respectively, and places solenoid valve 52 in line 50, solenoid valve 54 in line 24 downstream of evaporator 22 and upstream of line 50 and solenoid valve 56 in line 18-1 downstream of economizer heat exchanger 40 and upstream of line 50. Solenoid valves 52, 54, and 56 and EEV30 are all controlled by microprocessor 100 responsive to zone inputs. Where expansion device 20 is, as illustrated, an EEV, it also is controlled by microprocessor 100.

In "normal" operation of system 10, valves 52 and 56 are closed and hot high pressure refrigerant gas from compressor 12 is supplied via line 14 to condenser 16 where the refrigerant gas condenses to a liquid which is supplied via line 18 and idle economizer heat exchanger 40 to EEV20. EEV20 causes a pressure drop and partial flashing of the liquid refrigerant passing therethrough. The liquid-vapor mixture of refrigerant is supplied to evaporator 22 where the liquid refrigerant evaporates to cool the required space and the resultant gaseous refrigerant is supplied to compressor 12 via suction line 24 containing solenoid valve 54 to complete the cycle.

The operation described above is conventional and capacity is controlled through EEV20. Pursuant to the teachings of the present invention solenoid valve 54 can be rapidly pulsed to control the capacity of compressor 12. Since the pulsing will be more rapid than the response time of the system 10, the system 10 responds as though the valve 54 is partially open rather than being cycled between its open and closed positions. Modulation is achieved by controlling the percentage of the time that valve 54 is on and off. To prevent a vacuum pump operation, the "off" position of valve 54 may need to permit a limited flow.

To increase capacity of system 10, economizer heat exchanger 40 is employed. In economizer heat exchanger 40, lines 18 and 18-1 are in heat exchange relationship. Solenoid valve 56 is open and solenoid valve 52 closed and a portion of the liquid refrigerant in line 18 is directed into line 18-1 where EEV30 causes a pressure drop and a partial flashing of the liquid refrigerant. The low pressure liquid refrigerant passes into economizer heat exchanger 40 where the refrigerant in line 18-1 extracts heat from the refrigerant in line 18 causing it to cool further and thereby provide an increased cooling effect in evaporator 22. The refrigerant in line 18-1 passing through economizer heat exchanger 40 is supplied to compressor 12 via port 12-1 under the control of valve 56 which is, in turn, controlled by microprocessor 100. Line 18-1 delivers refrigerant gas to a trapped volume at an intermediate stage of compression in the compressor 12, as is conventional. However, according to the teachings of the present invention the economizer flow in line 18-1 and, as such, system capacity is controlled by rapidly cycling valve

56 to modulate the amount of economizer flow to an intermediate stage of compression in compressor 12. To lower the capacity of system 10, bypass line solenoid valve 52 is employed. In this arrangement, valve 56 is closed, and gas at intermediate pressure is bypassed from compressor 12 via port 12-1, line 18-1 and line 50 into suction line 24. The amount of bypassed gas and, as such, the system capacity is varied by rapidly cycling valve 52. Thus port 12-1 is used as both an economizer port and a bypass or unloading port.

From the foregoing, it should be clear that the rapid cycling of valves 52, 54 and 56, individually, allows for various forms of capacity control with the amount of time a particular valve is on relative to the time that it is off determining the degree of modulation of capacity. The frequency of modulation for typical systems can range from 0.1 to 100 seconds.

Although preferred embodiments of the present invention have been illustrated and described, other changes will occur to those skilled in the art. It is therefore intended that the scope of the present invention is to be limited only by the scope of the appended claims.

What is claimed is:

1. In a system serially including a compressor, a discharge line, a condenser, an expansion device, an evaporator and a suction line, means for achieving capacity control comprising:

a solenoid valve in said suction line;

means for rapidly pulsing said solenoid valve whereby the rate of flow in said suction line to said compressor is modulated;

a fluid path extending from a point intermediate said condenser and said expansion device to said compressor at a location corresponding to an intermediate point of compression in said compressor;

a bypass line connected to said fluid path and said suction line;

a solenoid valve in said bypass line;

means for rapidly pulsing said solenoid valve in said bypass line whereby the rate of flow of bypass to said suction line is modulated.

2. The capacity control of claim 1 further including;

an economizer circuit connected to said fluid path;

a solenoid valve in said economizer circuit; and means for rapidly pulsing said solenoid valve in said economizer circuit whereby the rate of economizer flow to said compressor is modulated.

3. In a system serially including a compressor, a discharge line, a condenser, an expansion device, an evaporator and a suction line, means for achieving capacity control comprising:

a solenoid valve in said suction line;

means for rapidly pulsing said solenoid valve whereby the rate of flow in said suction line to said compressor is modulated;

a fluid path extending from a point intermediate said condenser and said expansion device to said compressor at a location corresponding to an intermediate point of compression in said compressor;

an economizer circuit connected to said fluid path;

a solenoid valve in said economizer circuit; and means for rapidly pulsing said solenoid valve in said economizer circuit whereby the rate of economizer flow to said compressor is modulated.

* * * * *